US009546412B2

(12) United States Patent
Christopherson, Jr. et al.

(10) Patent No.: US 9,546,412 B2
(45) **Date of Patent: *Jan. 17, 2017**

(54) POWDERED METAL ALLOY COMPOSITION FOR WEAR AND TEMPERATURE RESISTANCE APPLICATIONS AND METHOD OF PRODUCING SAME

(75) Inventors: Denis B. Christopherson, Jr., Waupun, WI (US); Leslie John Farthing, Rugby (GB); Todd Schoenwetter, Waupun, WI (US); Gilles L'Esperance, Candiac (CA); Philippe Beaulieu, Montréal (CA)

(73) Assignee: Federal-Mogul Corporation, Southfield, MI (US)

( * ) Notice: Subject to any disclaimer, the term of this patent is extended or adjusted under 35 U.S.C. 154(b) by 966 days.

This patent is subject to a terminal disclaimer.

(21) Appl. No.: 12/419,683

(22) Filed: Apr. 7, 2009

(65) Prior Publication Data

US 2009/0252636 A1 Oct. 8, 2009

Related U.S. Application Data

(60) Provisional application No. 61/043,256, filed on Apr. 8, 2008.

(51) Int. Cl.

| | |
|---|---|
| ***C22C 37/06*** | (2006.01) |
| ***C22C 33/02*** | (2006.01) |
| ***B22F 9/08*** | (2006.01) |

(52) U.S. Cl.

CPC ..... *C22C 37/06* (2013.01); *B22F 9/082* (2013.01); *C22C 33/0285* (2013.01); *B22F 2998/10* (2013.01)

(58) Field of Classification Search

CPC .... C22C 1/1042; C22C 33/0285; C22C 33/04; C22C 33/06; C22C 37/06; B22F 9/08; B22F 9/082; B22F 2009/0824; B22F 2009/0828; B22F 2009/0848; B22F 2009/086; B22F 2009/0872; B22F 2301/35

(Continued)

(56) References Cited

U.S. PATENT DOCUMENTS 3,150,444 A 9/1964 Reen
3,556,780 A * 1/1971 Holtz, Jr. ..... 419/15

(Continued)

FOREIGN PATENT DOCUMENTS

CN 101497978 A 8/2009
CN 102057072 A 5/2011

(Continued)

OTHER PUBLICATIONS

Palma R H et al, "Sintering Behaviour of T42 Water Atomised High Speed Steel Powder Under Vacuum and Industrial Atmospheres With Free Carbon Addition", Powder Metallurgy.

(Continued)

*Primary Examiner* — Scott Kastler
*Assistant Examiner* — Vanessa Luk
(74) *Attorney, Agent, or Firm* — Robert L. Stearns; Dickinson Wright, PLLC

(57) ABSTRACT

A powder metal steel alloy composition for high wear and temperature applications is made by water atomizing a molten steel alloy composition containing C in an amount of at least 3.0 wt %; at least one carbide-forming alloy element selected from the group consisting of: Cr, V, Mo or W; an O content less than about 0.5 wt %, and the balance comprising essentially Fe apart from incidental impurities. The high carbon content reduces the solubility of oxygen in the melt and thus lowers the oxygen content to a level below which would cause the carbide-forming element(s) to oxidixe during water atomization. The alloy elements are thus not (Continued)

tied up as oxides and are available to rapidly and readily form carbides in a subsequent sintering stage. The carbon, present in excess, is also available for diffusing into one or more other admixed powders that may be added to the prealloyed powder during sintering to control microstructure and properties of the final part.

4 Claims, 1 Drawing Sheet

(58) Field of Classification Search
USPC ..... 75/228–250, 255, 252, 253, 254, 331,75/338–341, 343, 351, 355, 525; 148/321–327, 333–337; 420/9–71, 420/104–116, 122–124, 127, 129, 590; 428/546–569
See application file for complete search history.

(56) References Cited

U.S. PATENT DOCUMENTS

| | | | | |
|---|---|---|---|---|
| 3,704,115 | A * | 11/1972 | Wastenson et al. | 420/10 |
| 3,846,126 | A * | 11/1974 | Foley et al. | 419/23 |
| 4,121,927 | A | 10/1978 | Lohman et al. | |
| 4,216,015 | A | 8/1980 | Hickl et al. | |
| 4,348,433 | A | 9/1982 | Kammer et al. | |
| 4,361,604 | A | 11/1982 | Kushner et al. | |
| 4,822,415 | A | 4/1989 | Dorfman et al. | |
| 4,935,266 | A | 6/1990 | Steine et al. | |
| 5,066,523 | A | 11/1991 | Steine et al. | |
| 5,108,493 | A * | 4/1992 | Causton | 75/255 |
| 5,328,763 | A | 7/1994 | Terry | |
| 5,344,477 | A | 9/1994 | Stasko et al. | |
| 5,462,573 | A | 10/1995 | Baker et al. | |
| 5,522,914 | A | 6/1996 | Stasko et al. | |
| 5,635,255 | A | 6/1997 | Kwon et al. | |
| 5,856,625 | A | 1/1999 | Saunders et al. | |
| 6,095,107 | A | 8/2000 | Kloft et al. | |
| 6,095,126 | A | 8/2000 | Kloft et al. | |
| 6,123,748 | A | 9/2000 | Whitaker et al. | |
| 6,159,554 | A | 12/2000 | Kloft et al. | |
| 6,475,262 | B1 | 11/2002 | Maulik et al. | |
| 6,749,894 | B2 | 6/2004 | Subramanian et al. | |
| 6,756,083 | B2 | 6/2004 | Holmqvist et al. | |
| 6,887,585 | B2 | 5/2005 | Herbst-Dederichs | |
| 7,487,840 | B2 | 2/2009 | Gammage et al. | |
| 7,998,238 | B2 | 8/2011 | Takayama et al. | |
| 2002/0197500 | A1 | 12/2002 | Holmqvist et al. | |
| 2004/0206204 | A1 | 10/2004 | Holmqvist et al. | |
| 2005/0132843 | A1 | 6/2005 | Jiang et al. | |
| 2006/0063020 | A1 | 3/2006 | Barbezat | |
| 2006/0121292 | A1 | 6/2006 | Weaver et al. | |
| 2009/0162237 | A1 | 6/2009 | Rakowski et al. | |
| 2009/0252634 | A1 | 10/2009 | Scholl et al. | |
| 2009/0252636 | A1 | 10/2009 | Christopherson, Jr. et al. | |
| 2010/0047105 | A1 | 2/2010 | Bergstrom et al. | |
| 2011/0085930 | A1 | 4/2011 | Valls | |
| 2011/0254230 | A1 | 10/2011 | Jarosinski et al. | |
| 2013/0315772 | A1 | 11/2013 | Christopherson, Jr. et al. | |

FOREIGN PATENT DOCUMENTS

| | | | |
|---|---|---|---|
| CN | 102286702 | A | 12/2011 |
| DE | 3822874 | A1 | 1/1989 |
| DE | 19733306 | C1 | 5/1999 |
| DE | 19845349 | A1 | 4/2000 |
| DE | 102008032042 | B3 | 4/2010 |
| EP | 130177 | A1 | 1/1985 |
| EP | 266149 | A2 | 5/1988 |
| EP | 0 625 392 | A1 | 11/1994 |
| JP | 5339693 | A | 4/1978 |
| JP | 5339693 | B2 | 10/1978 |
| JP | 59064748 | A | 4/1984 |
| JP | S5964748 | | 4/1984 |
| JP | 8120397 | A | 5/1996 |
| JP | 2689513 | B2 * | 12/1997 |
| JP | 11106890 | A | 4/1999 |
| JP | 11172364 | A * | 6/1999 |
| JP | 2002309361 | A | 10/2002 |
| JP | 2003 055747 | A | 2/2003 |
| JP | 2006159269 | | 6/2006 |
| JP | 2006159269 | A | 6/2006 |
| JP | 2006316745 | A | 11/2006 |
| JP | 2008297572 | A | 12/2008 |
| WO | WO 98/58093 | A1 | 12/1998 |
| WO | 9961673 | A | 12/1999 |
| WO | 2006117030 | A1 | 11/2006 |
| WO | 2008017848 | A1 | 2/2008 |
| WO | WO2008/017848 | A1 | 2/2008 |
| WO | WO 2008/034614 | A1 | 3/2008 |
| WO | WO 2008/036026 | A1 | 3/2008 |
| WO | 2009112118 | A1 | 9/2009 |
| WO | 2009115157 | A1 | 9/2009 |
| WO | 2009126674 | A2 | 10/2009 |
| WO | 2013134606 | A2 | 9/2013 |

OTHER PUBLICATIONS

Maney Publishing, London, GB, vol. 32, No. 4, Jan. 1, 1989, pp. 291-299, XP000141953, ISSN: 0032-5899 *figure 11*.

Supplementary Eruopean Search Report dated May 28, 2014.

Xinqing Ma and Peter Ruggiero, Ultrasmooth, Dense Hardface Coating Applied by Advanced HVOF Process, Advanced Materials & Processes, Feb. 2013, p. 36-p. 38, vol. 171 Issue 2.

Liu et al., "Research on Plasma Piston Ring Surface about its Plasma Spraying and Wear Resistance," Diesel Engine, Dec. 31, 2004, pp. 38-40.

Fu et al., "Application of the Thermal Spraying Technology in Aeroengine Part and Its Service," vol. 1, No. 2, May 31, 2006, pp. 61-64.

International Search Report mailed Sep. 12, 2013 (PCT/US2013/029792).

* cited by examiner

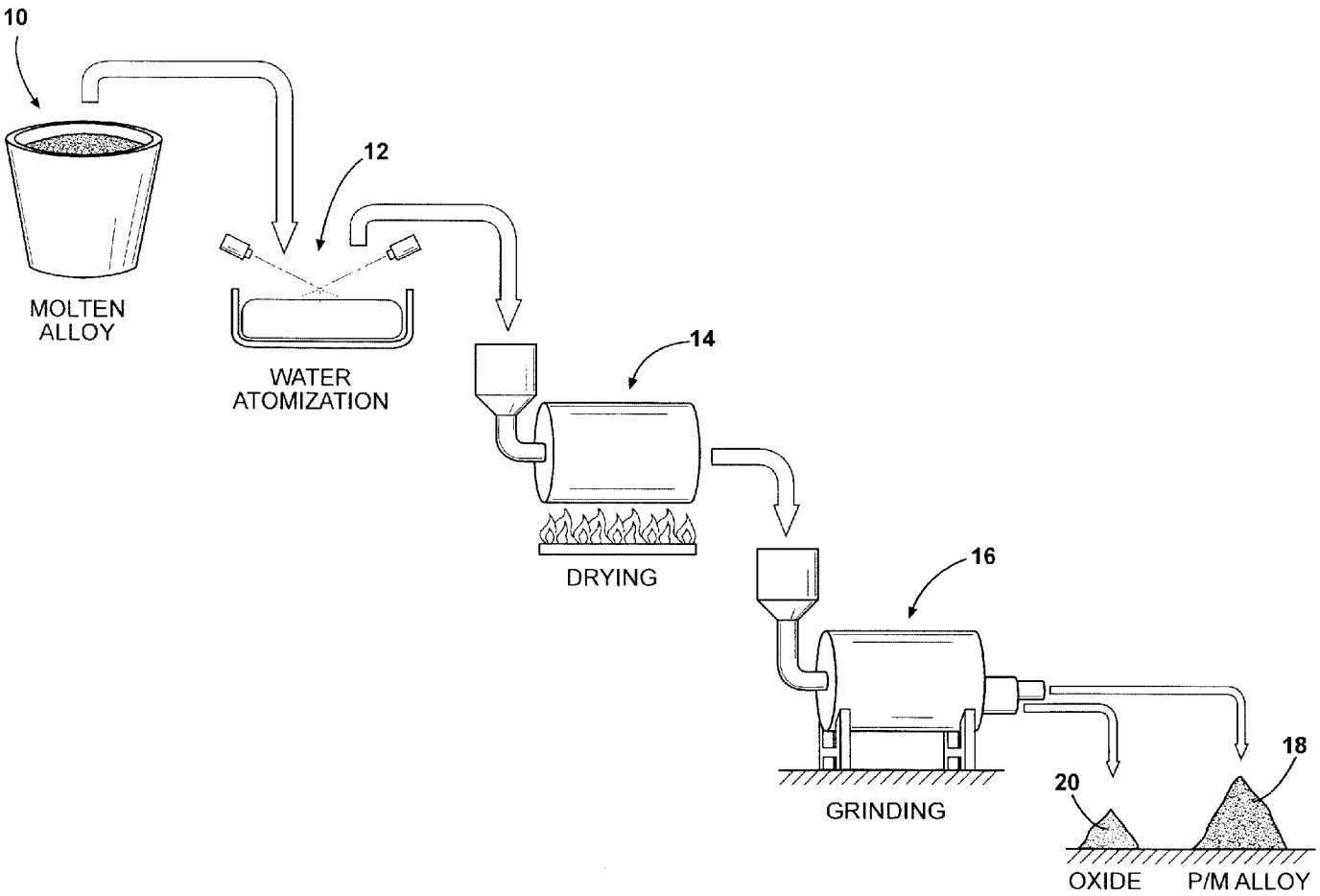
10
MOLTEN ALLOY
12
WATER ATOMIZATION
14
DRYING
16
GRINDING
18
P/M ALLOY
20
OXIDE

POWDERED METAL ALLOY COMPOSITION FOR WEAR AND TEMPERATURE RESISTANCE APPLICATIONS AND METHOD OF PRODUCING SAME

This application claims priority to U.S. Application Ser. No. 61/043,256, filed Apr. 8, 2008, and is incorporated herein by reference.

TECHNICAL FIELD

This invention relates generally to powdered metal hard prealloyed steel compositions suitable for compacting and sintering alone or admixed with other powder metal compositions to form powdered metal articles, and to methods of producing such hard alloy steel powders and parts made therefrom.

BACKGROUND OF THE INVENTION

High hardness prealloyed steel powder, such as tool steel grade of powders, can either be used alone or admixed with other powder metal compositions in the powder-metallurgy production of various articles of manufacture. Tool steels contain elements such as chromium, vanadium, molybdenum and tungsten which combine with carbon to form various carbides such as $M_6C$, MC, $M_3C$, $M_7C_3$, $M_{23}C_6$. These carbides are very hard and contribute to the wear resistance of tool steels.

The use of powder metal processing permits particles to be formed from fully alloyed molten metal, such that each particle possesses the fully alloyed chemical composition of the molten batch of metal. The powder metal process also permits rapid solidification of the molten metal into the small particles which eliminates macro segregation normally associated with ingot casting. In the case of highly alloyed steels, such as tool steel, a uniform distribution of carbides can be developed within each particle, making for a very hard and wear resistant powder material.

It is common to create the powder through atomization. In the case of tool steels and other alloys containing high levels of chromium, vanadium and/or molybdenum which are highly prone to oxidation, gas atomization is often used, wherein a stream of the molten alloy is poured through a nozzle into a protective chamber and impacted by a flow of high-pressure inert gas such as nitrogen which disperses the molten metal stream into droplets. The inert gas protects the alloying elements from oxidizing during atomization and the gas-atomized powder has a characteristic smooth, rounded shape.

Water atomization is also commonly used to produce powder metal. It is similar to gas atomization, except that high-pressure water is used in place of nitrogen gas as the atomizing fluid. Water can be a more effective quenching medium, so that the solidification rates can be higher as compared to conventional gas atomization. Water-atomized particles typically have a more irregular shape which can be more desirable during subsequent compaction of the powder to achieve a greater green strength of powder metal compacts. However, in the case of tool steels and other steels containing high levels of chromium, vanadium and/or molybdenum, the use of water as the atomizing fluid would cause the alloying elements to oxidize during atomization and tie these alloying elements up making them unavailable for reaction with carbon to form carbides. Consequently, if water atomization were employed, it may need to be followed up by a separate oxide reduction and/or annealing cycle, where the powder is heated and held at an elevated temperature for a lengthy period of time (on the order of several hours or days) and in the presence of a reducing agent such as powdered graphite, or other source of carbon or other reducing agent or by another reducing process. The carbon of the graphite would combine with the oxygen to free up the alloying elements so that they would be available for carbide formation during the subsequent sintering and tempering stages following consolidation of the powder into green compacts. It will be appreciated that the requirement for the extra annealing/reducing step and the addition of graphite powder adds cost and complexity to the formation of high alloy powders via the water atomization process.

SUMMARY OF THE INVENTION

According to one aspect of the invention, a method is provided for producing high alloy steel powder containing at least one of molybdenum, chromium, tungsten or vanadium using water atomization but in a manner that protects the oxidation-prone alloying element(s) from oxidizing during atomization so that the alloying element(s) are available to form carbides.

According to another aspect of the invention, the carbon level in the high alloy steel is significantly increased above what is stoichiometrically needed to form the desired carbides. The increased carbon has the beneficial effect of significantly reducing the solubility of oxygen in the molten steel, thus suppressing the oxygen level in the melt. By effectively reducing the oxygen level, the alloy elements are less prone to oxidization in the melt and during atomization. Consequently, one or more of the alloying elements of molybdenum, chromium, tungsten and/or vanadium remain free following the melt and atomization to combine with the carbon to achieve a finely dispersed, high volume concentration of carbides in the particle matrix. Thus, the high concentration of carbon serves as both in a protective role by reducing the oxygen content in the melt to keep the alloy elements from oxidizing and in a property development role by later combining with the unoxidized free alloy elements to produce a high concentration of finely dispersed carbides in the powder during sintering. The result is a fully alloyed powder that is inexpensively produced and with an elevated hardness that is believed to be above that typically achieved by either gas or conventional water atomized processes with comparable alloy compositions having lower carbon levels. The high carbon water-atomized powder also avoids the need for subsequent thermal processing (extended annealing and/or oxide reduction) as is necessary with low carbon levels to reduce oxygen and produce the appropriate microstructure.

According to another aspect of the invention, the "high" amount of carbon included in the alloy composition is defined as an amount in excess of the stoechiometric amount of carbon required to form the desired type and volume percentage of carbides in the particles. The percentage of carbon deemed to be "high" may thus vary depending upon the particular alloy composition.

According to another aspect of the invention, a low cost high alloy steel powder is produced by the above water atomization process. The water-atomized powder alloy contains at least one alloy selected from the group consisting of: Cr, V, Mo or W and has a C content of at least 3.0 wt %.

According to another aspect of the invention, a low cost water-atomized tool steel alloy powder is provided having a C content of at least 3 wt. %, a Cr content above 10 wt. %, a Mo content below 5 wt. % and an oxygen content below about 0.5 wt. %, with about 0.2 wt. % oxygen having been achieved. In the as-atomized state, the carbide-forming alloys are present in a super saturated state due to the rapid solidification that occurs during water atomization. The unoxidized super saturated state of the alloying elements combined with the high carbon content allows carbides to precipitate and fully develop very quickly (within minutes) during the subsequent sintering stage without the need for an extended prior annealing cycle (hours or days), although the powder can be annealed if desired, for example, from 1 to 48 hours at temperatures of about 900-1100° C., or according to other annealing cycles if desired. It is understood that annealing is not mandatory, but is optional. A high volume percent of carbides can be produced (on the order of about 47-52 vol %) and the carbides are uniformly dispersed and very fine (about 1 to 2 μm). The resultant high volume density carbide precipitates provides for a very hard powder, having a microhardness in the range of 1000-1200 $Hv_{50}$.

According to a further aspect of the invention, a specific alloy composition has been made having, in weight percent, 3.8° C., 13 Cr, 4 V, 1.5 Mo and 2.5 W, with the balance being essentially Fe. The powder particles after sintering have a volume fraction of chromium-rich carbides of about 40-45 vol % and vanadium-rich carbides of about 7 vol %. The chromium-rich carbides have a size of about 1-2 μm. The particles have a microhardness of about 1000-1200 $Hv_{50}$. These properties can be essentially maintained through sintering and tempering, including a hardness above 1000 $Hv_{50}$, although some of the excess carbon contained in the particles above that needed to develop the carbides may diffuse out of the hard particles if admixed with another ferrous powder composition having a lower carbon content. This excess carbon diffusion has the added benefit of eliminating or at least decreasing the need for additions of carbon-rich powders (e.g., powder graphite) that is sometimes added during compaction and sintering for control of microstructure and property enhancement. In addition, pre-alloyed carbon will reduce the tendency for graphite segregation which can occur with separate graphite additions.

According to a further aspect of the invention, the water-atomized powder is mechanically ground after atomizing to break and separate out any outer oxide skin that may have formed during water atomization. It is to be appreciated that while the outer surface of the particle may become oxidized even with the increased carbon content of the alloy, the alloy constituents within the particle are protected from oxidation during the melt and atomizing. In some cases, the O content may be low enough (such as below 0.03 wt %) where any oxide on the surface of the powder is minimal and may be tolerated without removal, thus making grinding optional in some cases for at least the purpose of breaking the outer oxide layer. The mechanical grinding can be advantageously used to both reduce the size of the particles and to reduce the effective oxygen content of the particles by breaking off the outer oxidized layer of material, if desired, that may have formed during water atomization.

According to a further aspect of the invention, additions of sulfur, manganese, and other elements, including incidental and/or unavoidable impurities, which do not impair the desired properties of the alloy are also contemplated within the scope of the invention.

BRIEF DESCRIPTION OF THE DRAWINGS

These and other features and advantages of the invention will become more apparent to those skilled in the art from the detailed description and accompanying drawing which schematically illustrates the process used to produce the powder.

DETAILED DESCRIPTION OF A PREFERRED EMBODIMENT

A process for producing high carbon, high alloy steel powder is schematically illustrated in the sole drawing FIG. 1.

A molten batch 10 of the fully alloyed steel is prepared and fed to a water atomizer 12, where a stream of the molten metal 10 is impacted by a flow of high-pressure water which disperses and rapidly solidifies the molten metal stream into fully alloyed metal droplets or particles of irregular shape. The outer surface of the particles may become oxidized due to exposure to the water and unprotected atmosphere. The atomized powder is passed through a dryer 14 and then onto a grinder 16 where the powder is mechanically ground or crushed. A ball mill or other mechanical reducing device may be employed. The mechanical grinding of the particles fractures and separates the outer oxide skin from the particles. The particles themselves may also fracture and thus be reduced in size. The ground particles are then separated from the oxide to yield water-atomized powder 18 and oxide particles 20. The powder 18 may be further sorted for size, shape and other characteristics normally associated with powder metal.

The batch 10 of alloy steel is one that has a high alloy content and a high carbon content and a low oxygen content. The alloy content includes carbide-forming elements characteristic of those employed in tool steel grade of steels, namely at least one of chromium, molybdenum, vanadium or tungsten. The "high" content of carbon is defined as that in excess of the amount which is stoichiometrically needed to develop the desired type and volume % of carbides in the particles. The "low" oxygen content means oxygen levels below about 0.5 wt %.

One reason for adding the excess carbon in the melt is to protect the alloy from oxidizing during the melt and during atomization. The increased carbon content of the steel decreases the solubility of oxygen in the melt. Depleting the oxygen level in the melt has the benefit of shielding the carbide-forming alloy constituents from oxidizing during the melt or during water atomization, and thus being free to combine with the carbon to form the desired carbides during sintering. Another reason for the high level of carbon is to ensure that the matrix in which the carbides precipitate reside is one of essentially martensite and/or austenite, particularly when the levels of Cr and/or V are high.

For at least cost reasons, there is a desire to increase the amount of some of the carbide-forming alloy elements over others. Thus, while Mo is an excellent choice for forming very hard carbides with a high carbide density, it is presently very costly as compared, to say, Cr. So, to develop a low cost tool grade quality of steel that is at least comparable in performance to a more costly and conventional M2 grade of tool steel, it is proposed to replace more expensive forming elements with less expensive elements while increasing the carbon content to achieve the desired end result by way of properties and cost structure. This is done by adding to the steel alloy Cr at an amount of at least 5 wt. %, reducing the Mo to less than 1.5 wt. % and increasing the amount of C to above 3 wt %. Additions of V, W can vary depending upon the desired carbides to be formed. Table 1 below shows an example of a specific alloy composition LA prepared in connection with the present invention, along with the composition of commercial grade of M2 tool steel for comparison.

TABLE 1

| Alloy compositions (in wt. %) | | | | | | |
|---|---|---|---|---|---|---|
| Powder | Cr | V | Mo | W | C | Fe |
| LA | 13 | 4 | 1.5 | 2.5 | 3.8 | bal. |
| M2 | 4 | 2 | 5 | 6 | 0.85 | bal. |

Inventive powder LA was prepared according to the process described above and schematically illustrated in the drawing FIGURE. It was shown to have a very high volume % of chromium-rich carbides, on the order of about 40-45 vol. %, and vanadium-rich carbides on the order of about 7 vol. %. The chromium-rich carbides have a size of about 1-2 μm and the V-rich carbides have a size of about 1 μm. The surrounding matrix of the particles in which the carbides were precipitated was essentially martensitic with essentially no ferrite. Austenite may be permissible. The microhardness of the LA particles was measured to be in the range of about 1000-1200 $Hv_{50}$ in the sintered condition. The hardness was maintained above a 1000 $Hv_{50}$ after compacting, sintering and tempering when the LA particles were admixed as hard particles at 15 and 30 vol. % with a primary low carbon, low alloy powder composition. Some of the carbon from the hard particles was shown to have diffused into the neighboring lower carbon content primary powder matrix material of the admix. Controlling the sintering and tempering cycles allows one to control the properties of the primary matrix, including varying amounts of ferrite, perlite, bainite and/or martensite. Additions, such as MnS and/or other compounds may be added to the admix to alter the properties of the admix, for example to improve machinability. The LA hard particles remain essentially stable and their properties essentially uninhibited by subsequent heat treatments employed to develop the properties of the primary matrix material.

The invention has been described in connection with presently preferred embodiments, and thus the description is exemplary rather than limiting in nature. Variations and modifications to the disclosed embodiment may become apparent to those skilled in the art and do come within the scope of the invention. Accordingly, the scope of invention is not to be limited to these specific embodiments, but is defined by any ultimately allowed patent claims.

What is claimed is:

1. A pre-sintered powder metal composition, consisting essentially of:

C in an amount of about 3.8 wt %; Cr in an amount of about 13 wt %; V in an amount of about 4 wt %; Mo in an amount of about 1.5 wt %; Win an amount of about 2.5 wt %; an O content about 0.2 wt %, and the balance Fe and incidental impurities.

2. The composition of claim 1, wherein said powder is either annealed or unannealed.

3. The composition of claim 1, wherein the powder is mechanically ground.

4. The composition of claim 1, wherein the powder is unground.

* * * * *